US007015420B2

(12) United States Patent
Lok

(10) Patent No.: US 7,015,420 B2
(45) Date of Patent: Mar. 21, 2006

(54) HAIR BRUSHING APPLIANCE

(75) Inventor: Chun Yin Lok, Hong Kong SAR (CN)

(73) Assignee: Kenford Industrial Company Ltd., New Territories (HK)

( * ) Notice: Subject to any disclaimer, the term of this patent is extended or adjusted under 35 U.S.C. 154(b) by 130 days.

(21) Appl. No.: 10/730,394

(22) Filed: Dec. 8, 2003

(65) Prior Publication Data

US 2005/0123286 A1 Jun. 9, 2005

(51) Int. Cl.
*A45D 1/04* (2006.01)

(52) U.S. Cl. ..... 219/222; 219/227

(58) Field of Classification Search ..... 15/23; 132/120, 328; 219/200–201, 221–227
See application file for complete search history.

(56) References Cited

U.S. PATENT DOCUMENTS 3,349,782 A * 10/1967 Sawin ..... 132/119.1
4,222,398 A * 9/1980 Fromman ..... 132/238
4,419,565 A * 12/1983 McGaw ..... 219/222
4,664,132 A * 5/1987 Schillig ..... 219/222

* cited by examiner

*Primary Examiner*—Tu Hoang
(74) *Attorney, Agent, or Firm*—Alix, Yale & Ristas, LLP

(57) ABSTRACT

A hair brushing appliance includes a housing, a motor located within the housing, a brush extending from the housing, and a transmission relaying output torque of the motor to the brush. A slippage mechanism associated with the transmission allows the motor to turn, should the brush stop turning such as might occur if the brush snags with long hair in use.

3 Claims, 3 Drawing Sheets

HAIR BRUSHING APPLIANCE

BACKGROUND OF THE INVENTION

The present invention relates to hair curling brushes. More particularly, although not exclusively, the invention relates to an electric hair curling brush having a motor-driven roller and a clutch for preventing continuous rotation of the roller; should a user's hair become entangled upon the roller in use.

Electric hair curling brushes comprise a bristled roller through which heated air is blown for passage through a plurality of apertures against a user's hair wrapped around the roller and passing in between the bristles. Whilst placing the bristled roller against the hair in such manner that the hair strands pass in between the bristles, the user grasps a handle extending longitudinally of the roller and turns the handle manually to cause the hair to be wrapped around the roller. An electric fan blows air across a heater for passage through the roller, out through the apertures in between the bristles to impinge upon the hair.

A problem with such known hair curling brushes is in the requirement to manually turn the handle and thus the roller. One can only turn the handle throughout a limited angle without re-gripping the handle and turning again.

A hair curling brush having a motor-driven roller would ameliorate the above problem, but would present another problem—namely that of hair-pulling and possible injury, should the user's hair become snagged upon the roller in use.

OBJECTS OF THE INVENTION

It is an object of the present invention to overcome or substantially ameliorate at least one of the above disadvantages and/or more generally to provide an improved hair curling brush having a motor-driven roller and safety clutch interposed between the motor and the roller.

DISCLOSURE OF THE INVENTION

There is disclosed herein a hair curling appliance comprising:

a housing, a motor located within the housing, a brush extending from the housing, a transmission relaying output torque of the motor to the brush, and a slippage mechanism associated with the transmission to allow the motor to turn, should the brush stop turning in use.

Preferably, the hair curling brush further comprises a heater and a fan blowing air across the heater to the roller.

Preferably, the transmission comprises a gearbox.

Preferably, the slippage mechanism comprises a clutch associated with gears in the gearbox.

Preferably, the clutch comprises a plurality of profiled intermeshing teeth.

Preferably, the appliance further comprises a spring biasing the profiled teeth into engagement with one another and wherein force applied by the spring upon the clutch defines a pre-set torque transmission limit of the gearbox.

Preferably, the clutch is formed integrally with a gear of the gearbox.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

In the accompanying drawings there is depicted schematically a hair curling appliance 10. The appliance comprises a housing having a handle portion 12 by which the appliance is grasped in use. There is a bristled roller or brush 11 projecting from front end of the device 10 through which heated air is blown for delivery via a plurality of surface apertures as depicted.

Figure 1:
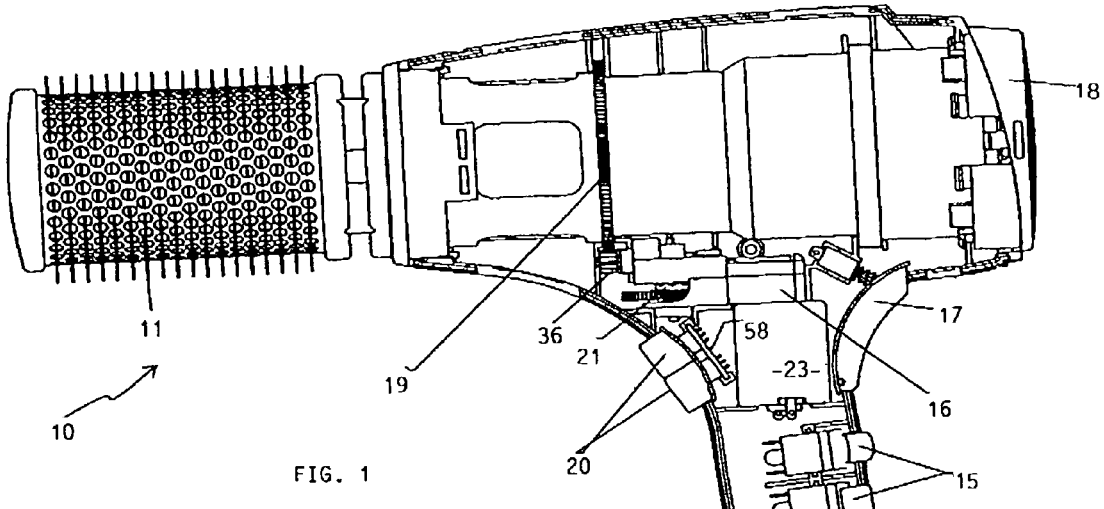
FIG. 1 is a schematic cross-sectional elevation of a hair curling appliance.
Figure 2:
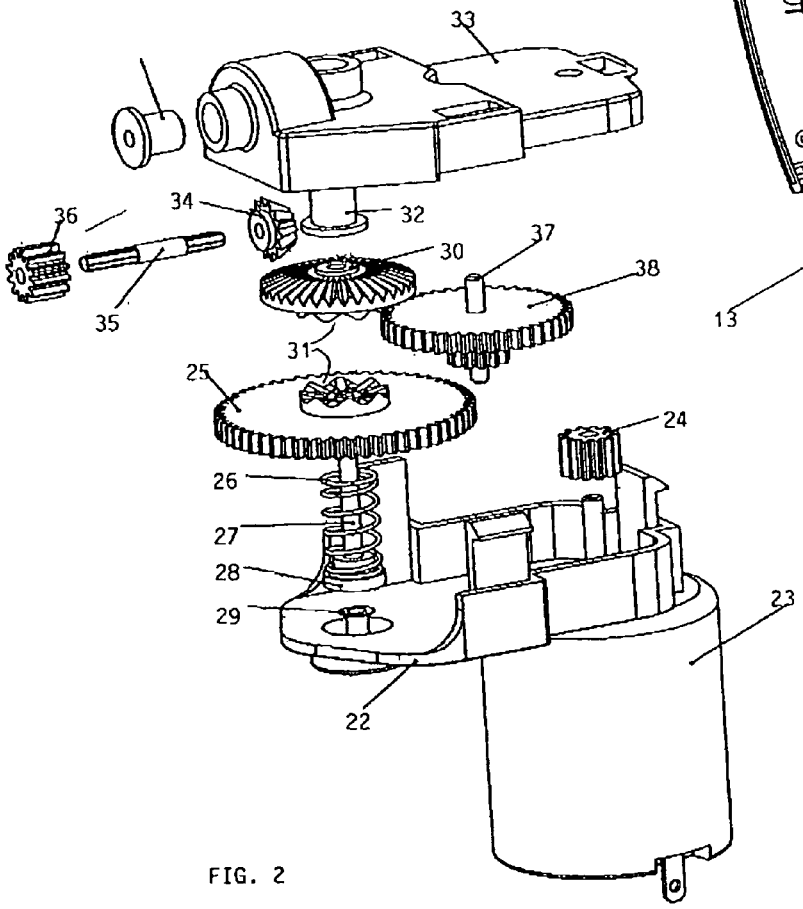
FIG. 2 is a schematic parts-exploded perspective illustration of the hair curling appliance's gearbox.
Figure 3:
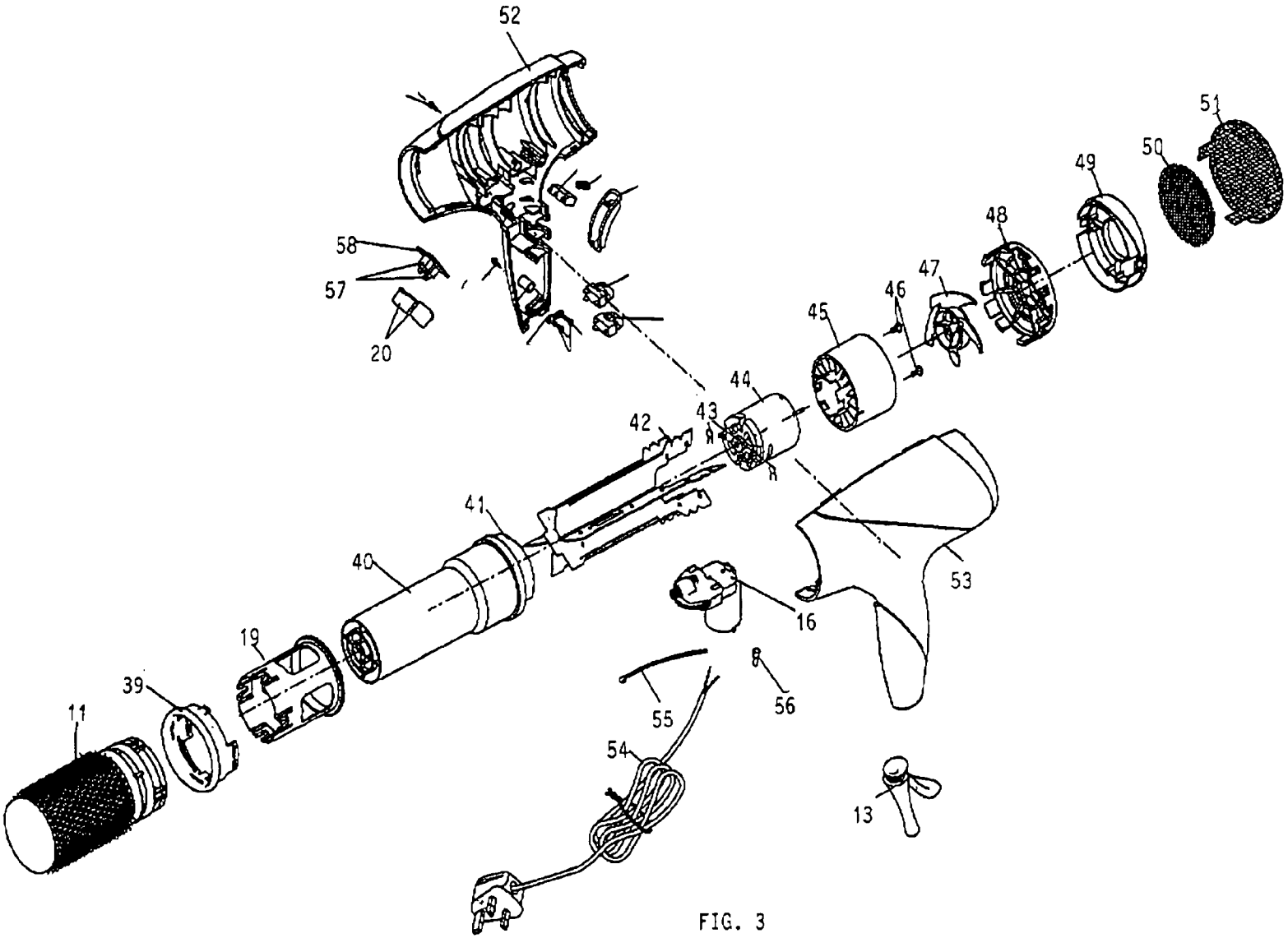
FIG. 3 is a schematic parts-exploded perspective illustration of the appliance.
Figure 4:
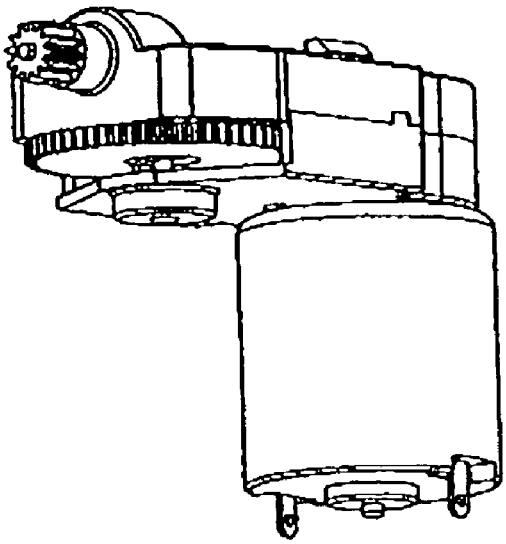
FIG. 4 is a schematic perspective illustration of the gearbox and motor.
Figure 5:
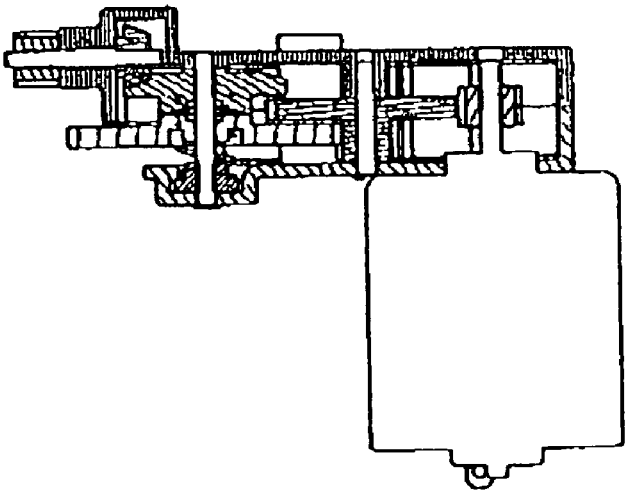
FIG. 5 is a schematic cross-sectional elevation of the gearbox and motor of FIG. 4.

Situated immediately behind the brush 11 is cap a 39 behind which a roller gear 19 is located. As shown in FIG. 3, the roller gear 19 is drum-shaped having gear teeth about its rear-most periphery. A heater shroud 40 extends into the roller gear 19 and houses a heater 42 hating a number of radially projecting elongate heating fins as shown in FIG. 3.

A fan motor 44 is mounted within a fan motor mounting frame 45 immediately behind the heater 42 and draws air in through a grille 48 that sits behind a removable end cap 49 upon which a filtering net 50 and filtering mesh 51 are positioned. Small capacitors 43 are associated with the fan motor 44 and/or heater 42.

The housing comprises a pair of housing halves 52 and 53 of moulded plastics material between which the above-described components are mounted.

There is a brush rotation control button set 20 in a trigger position of the housing. A number of buttons 15 for adjusting the speed of the fan motor 44 and the heater 42 are also provided. There is a cold shot button 17 which when depressed cuts electric power to the heater 42.

At the bottom of the handle 12, there is a power cord sleeve 13 and a hanging loop 14. An electric power cord 54 extends through the power cord sleeve 13. A cable tie 55 and connector 56 would be provided for the cord 54.

Also located within and supported between the housing halves 52 and 53 is a gearbox 16 comprising a gearbox casing upper 33 and a gearbox casing lower 22 each formed as a metal casting or plastics moulding. An electric motor 23 drives the gearbox which in turn drives the roller gear 19 to cause rotation of the brush 11.

Electric motor 23 has an output shaft passing through the gearbox casing lower 22 to receive a pinion 24. The pinioned 24 drives the large-diameter teeth of an intermediate gear 38. The small diameter teeth of the intermediate gear drive a clutch gear 25. The clutch gear 25 is mounted slidably upon a shaft 27 having a retainer 28 at its bottom end that is fitted upon a boss 29 of the gearbox casing lower 22. A coil spring 26 surrounds the shaft 27 to bias the clutch gear 25 upwardly. It should be noted that the thickness of the clutch gear 25 is less than that of the pinion 24 to enable continuous intermeshing of the pinion with the clutch gear, should the clutch gear move up and down along shaft 27. The clutch gear has a number of profiled clutch teeth 31 formed integrally therewith. The clutch teeth press against and mesh with correspondingly profiled clutch teeth at the underside of a crown wheel 30. The crown wheel rotates upon the shaft 27 and intermeshes with a pinion 34. The pinion 34 is fixed upon a shaft 35 at the opposite end of which another pinion 36 is fixed. Pinion 36 engages with the roller gear 19.

The spring 26 maintains contact between the profiled teeth 31 during normal use of the appliance. Should the user's hair becomes snagged about the brush 11, there will be a reaction torque build-up in the gearbox and the spring 26 will be unable to maintain engagement between the profiled teeth. That is, the teeth will ride upon one another as the clutch gear 25 continues to rotate by action of the motor 23. This might produce an audible and/or tactile feedback to the user whereupon she can release finger pressure from the brush rotation control button.

It should be appreciated that modifications and alterations obvious to those skilled in the art are not to be considered as beyond the scope of the present invention. For example, instead of providing a clutch with profiled teeth, a flat plate clutch might be provided. Furthermore, instead of providing a clutch, there might be provided a pair of pulleys about which a belt extends—which belt might slip upon one or both of the pulleys, should the brush becomes snagged.

What is claimed is:

1. A hair brushing appliance comprising:

a housing, a motor located within the housing, a brush extending from the housing, a transmission relaying output torques of the motor to the brush, and a slippage mechanism associated with the transmission to allow the motor to turn, as said brush is stopped turning in use, said slippage mechanism further comprising a clutch associated with gears in a gearbox, said clutch comprising a plurality of profiled intermeshing teeth and a spring biasing the profiled intermeshing teeth into engagement with one another, and wherein force applied by the spring upon the clutch defines a pre-set torque transmission limit of the gearbox.

2. The appliance of claim 1 further comprising a heater and a fan blowing air across the heater to the brush.

3. The appliance of claim 1 wherein the clutch is formed integrally with a gear of the gearbox.

* * * * *